US006554265B2

(12) United States Patent
Andronica

(10) Patent No.: US 6,554,265 B2
(45) Date of Patent: Apr. 29, 2003

(54) UNIVERSAL WORKHOLDING V FIXTURE CONVERTABLE TO OTHER APPLICATIONS

(76) Inventor: Randall C. Andronica, 1815 Coleman St., Brooklyn, NY (US) 11234

( * ) Notice: Subject to any disclaimer, the term of this patent is extended or adjusted under 35 U.S.C. 154(b) by 0 days.

(21) Appl. No.: 09/829,148

(22) Filed: Apr. 9, 2001

(65) Prior Publication Data

US 2001/0045695 A1 Nov. 29, 2001

Related U.S. Application Data

(60) Provisional application No. 60/195,815, filed on Apr. 11, 2000.

(51) Int. Cl.[7] ..... B25B 1/24
(52) U.S. Cl. ..... 269/268
(58) Field of Search ..... 269/268, 902, 269/900, 282, 289 R, 257, 259, 258, 270

(56) References Cited

U.S. PATENT DOCUMENTS

| | | | | |
|---|---|---|---|---|
| 550,767 A | | 12/1895 | Thielscher | |
| 810,319 A | | 1/1906 | Blazej | |
| 1,535,570 A | | 4/1925 | Bryant | |
| 2,543,140 A | | 2/1951 | Vickerman | |
| 2,932,995 A | | 4/1960 | Durfee | |
| 3,423,885 A | | 1/1969 | Crandall | |
| 4,445,678 A | * | 5/1984 | George | 269/902 |
| 4,579,322 A | | 4/1986 | Schwarz | |
| 4,623,156 A | * | 11/1986 | Moisson et al. | 269/902 |
| 4,650,379 A | | 3/1987 | Jaskolski | |
| 4,723,771 A | * | 2/1988 | Perret-Gentil | 269/902 |
| 4,790,695 A | * | 12/1988 | Abernethy | 269/902 |
| 6,000,688 A | * | 12/1999 | Giangrasso | 269/43 |
| 6,254,077 B1 | * | 7/2001 | Ruket, Jr. | 269/902 |

* cited by examiner

*Primary Examiner*—Lee Wilson
(74) *Attorney, Agent, or Firm*—Galgano & Burke

(57) ABSTRACT

A workholding device for holding a workpiece securely for machining. One embodiment comprises a V fixture. Embodiments of the present invention are designed to be versatile and to provide the ability to accomplish other tasks beyond workholding, for example, enabling the punching of parts, the dressing of diamond wheels, sharpening drills of a wide range of sizes, and enabling deep hole center drilling.

18 Claims, 11 Drawing Sheets

FIG. 14
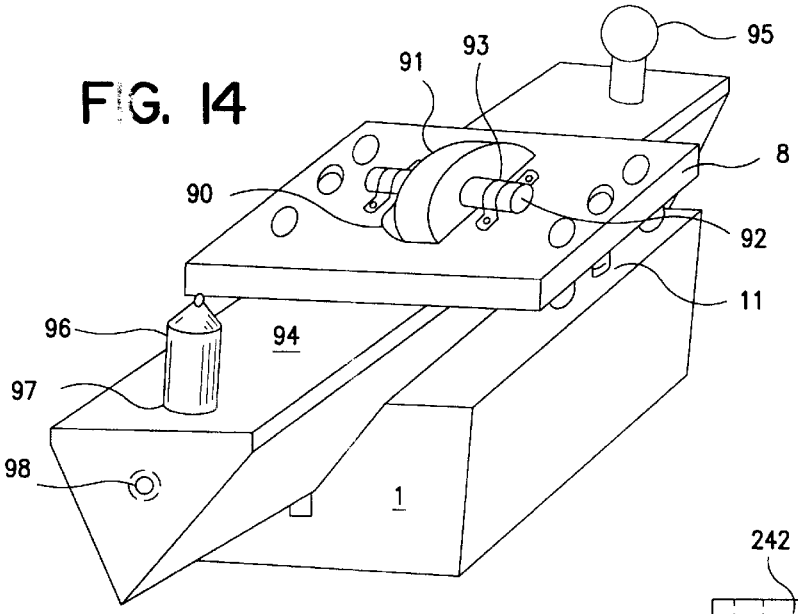
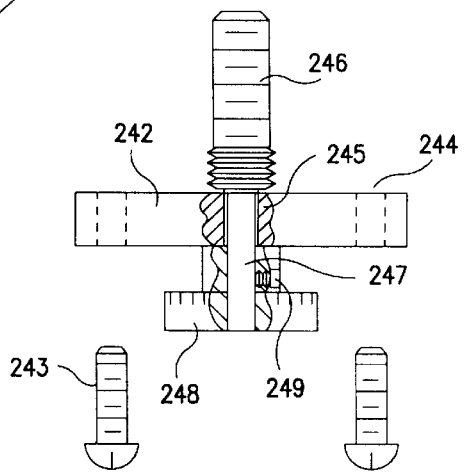
FIG. 14D
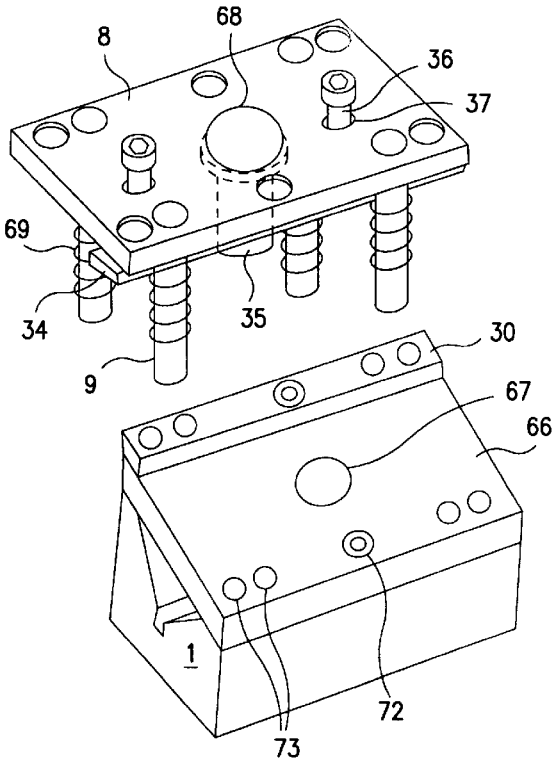
FIG. 14A
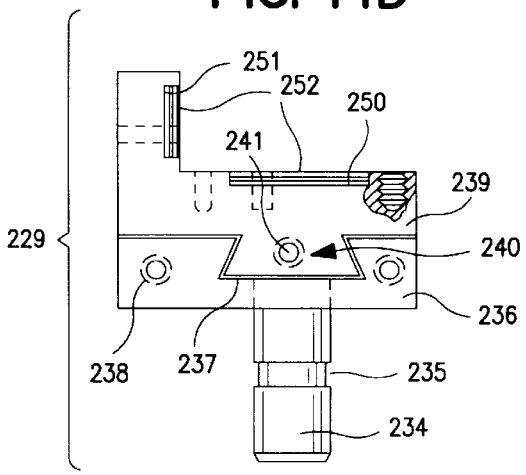
FIG. 14C

UNIVERSAL WORKHOLDING V FIXTURE CONVERTABLE TO OTHER APPLICATIONS

RELATED APPLICATION DATA

The present application claims priority on provisional application Ser. No. 60/195,815, which was filed Apr. 11, 2000.

BACKGROUND OF INVENTION

The current invention relates to improvements in workholding devices and in V block design in particular. V blocks have been in use in the machine tool industry since at least the 1800's. They are used for holding parts for machining or inspection. Typically a V is machined or ground centrally in a block which has provision for accomodating a horse shoe style clamp to secure the part in the V. More advanced designs enable the block to be held on up to five sides. Nonetheless, the prior art suffers from numerous shortcomings which include low holding power, marred workpieces, bent screws, a high profile—which creates tool interference and a lack of versatility.

The screw actuated quill of a lathe's tailstock requires a close tolerance bore in accurate alignment with the headstock. Errors in the vertical alignment are not easily corrected. The clearance between bore and quill and the wear of same is an issue of concern. The stroke depth of the tool is quite limited and the operation of cranking the handle is slow and tedious, especially for "deep" drilling. Additionally, thru the tool coolant drills require special coolant adaptors as the back of the tailstock is "closed off" by the actuating screw.

The current invention seeks to overcome the disadvantages of the prior art and offer additional advantages as will be seen.

PRIOR ART

In 1895 Thielcher discloses a V type jig in U.S. Pat. No. 550,767 in which the work is secured by a"strap" secured by screws into threaded lands on either side of the V. The inverted nature of this jig and the inaccessibility of the work limits the tool to cross drilling applications on a workpiece. In 1906 Blazej (U.S. Pat. No. 810,319) shows a V block having tangent contact drill guide being vertically adjustable by legs straddling either side of the block. Screws on either side of the block secure the position. This prevents turning the block on it side for additional operations. Additionlly the straps cannot exert any considerable clamping force on the work by nature of its design. And in fact, Blazej reverts to a more conventionl horse shoe clamping arrangement on the opposite V block segment. Blazej also teaches the use of a threaded rod connecting V segments. An arrangement utilized in the lathe embodiment of the current invention.

Bryant (U.S. Pat. No. 1,535,570) teaches a V block having threaded holes on the lands on either side of the block to secure and position the V shaped workholding clamp. The threads do not extend thru the block and limit workholding to the V cavity. Additionlly, the clamp has a high profile which may interfere with machining operations. Furthermore, small diameter workpieces are located at the bottom of the V making it less accessible to a cutting tool. And, the clamp will not allow the block to be held on the clamping side.

U.S. Pat. No. 2,543,140 to Vickerman shows a hand wrench having a tangent clamping arrangement with a reversible jaw bearing some resemblence to the current invention.

The patent to Durfee U.S. Pat. No. 2,932,995 bears the strongest resemblence to the current invention. He shows a block having a single central V and flat base (although both are relieved). Additionally, he also shows threaded holes in the lands adjacent to the the V. He also illustrates an I shape tangent plate which is presumably secured at its ends to the block. In addition he also discloses the use of a V liner. This design however, lacks a salient feature of the current invention—the guide pins secured in the tangent clamp plate and the counterbore feature which recess the securing screws permitting turning the fixture on any side. Additionlly, the threaded holes in Durfee' design are not threaded completely thru the block limiting the tool to holding the work within the V cavity.

The Crandall U.S. Pat. No. 3,423,885 teaches a V block with threaded holes adjacent the V cavity securing keyway style clamps and having sine bars secured to the corners of the block. The keyway clamps lack the fixed guide pins of the current invention and the securing screws are not recessed. Additionally, he utilizes different size clamps for different size workpieces, and the threaded holes do not go thru the block, limiting the tool to holding work within the V. The sine capability of the current invention utilizes removable sine bases which are only used when required. The ability to remove the base results in a smaller dimension which can be a consideration when holding the block in a vise, and it results in greater holding power on a magnetic chuck with the flat surface making full contact with the magnetic chuck. Additionally, Crandall doe not teach the use of a Y axis sine bar which enables producing angular features other than 45 and 90 degrees.

Irwin discloses an aligned split V block fixture in U.S. Pat. No. 4,445,678. This application is achieved by a different method with the current invention. He also shows threaded holes opposite the V with a clamping arrangement very similar to Bryant. Additionally he utilizes V liners similar to the tailstock embodiment of the current invention, except his liners fit in a step. The patent to Schwarz U.S. Pat. No. 4,579,322 discloses a cable vise that has clamping arrangement bearing resemblence to the current invention. The Jaskolski U.S. Pat. No. 4,650,379 divulges a multi-pin V fixtures with flat sides joined by dowel pins and having recessed screws securing the fixture as with the current invention. However, Jaskolski utilizes a multi-v arrangement and reverts to set screws to secure the work. Additionlly, the multi-V arrangement sacrifices the versatility and number of operations that can be performed as with the single V-cavity fixture.

The patent to Abernathy U.S. Pat No. 4,790,695 has similar features to the current invention. He shows a multiple level modular fixture with drill bushings in a clamping plate having guide rods aligning the various members. The guide rods are threaded at their ends and protrude above the surface of the fixture. While the workpiece may be drilled in more than one plane it is rather a cumbersome fixture geared to production drilling of parts and it could not be inverted or held in a vise for use on various machines.

None of the prior art achieves the versatility of operations and range of workpieces that may be accomodated by the current invention. And none suggest any uses beyond merely workholding.

OBJECTS OF INVENTION

It is therefore an object of the current invention to provide a workholding V fixture that can hold round, square, hexagonal, rectangular, threaded, or irregular parts. It is an object of the current invention to provide a workholding device that can hold multiple workpieces. It is another object of the invention to hold a workpiece securely for machining. Another object is to provide a non-marring grip. It is yet another object to provide a workholding device that can be held on any side for machining. A further object is to provide a low profile so as to facilitate machining by minimizing tool interference. It is still a further object to provide a versatile device capable of holding workpieces to replicate itself and its accessories, and further that can be adapted to accomplish a range of tasks beyond merely workholding which include punching parts, dressing diamond wheels, sharpening very small and very large drills, performing deep hole center drilling, generating radii on a part and centerless grinding workpieces. And another objective is to extend the clamping and linear motion concepts of the invention to replacing the screw quill arrangement on the tailstock of a lathe.

SUMMARY OF INVENTION

The current invention is comprised of a cast iron or steel block having a central V machined parallel to a flat base. On the lands adjacent to either side of the V area are a series of holes. Typically two reamed thru holes are laid out symetrically along each land.

A plate or tangent clamp with matching holes to the V block is utilized to secure the workpiece. The tangent clamp has pins pressed into the plate matching the reamed thru holes in the block. The pins may be internally threaded. Counterbored holes in the plate match the threaded holes in the block permitting the screw heads to be recessed allowing the device to be held on any side. The plate may be utilized on either side of the block to secure a workpiece. An alternative means of securing the work is a matching V clamp having pins pressed or otherwise secured into the lands on either side of the V corresponding to the reamed holes in the block and likewise having counterbored holes corresponding to the tapped holes in the block to accomodate and recess screw heads. This arrangement is utilized for producing parts with symetrical features.

A number of accessories extend the range of workpieces the block may hold or allow other operations to be performed. Magnetic parallels allow smaller parts to be held in the fixture. Another method to accomodate smaller work is to utilize a square workpiece which has a step milled on opposing sides, thereby resembling the letter W.

In addition, sine bar bases (either X,Y or Z axis) may be secured to the block enabling the production of angular features on a workpiece.

Partial length clamps may be utilized to accomodate headed or special workpieces. Keyway clamps facilitate machining along the axis or chamfering of workpieces.

A center locater in conjunction with a magnetic base facilitates rapid setups on a drill press.

A clear window clamp may be utilized for part inspection.

A length of filler V stock drilled to accomodate a diamond dresser on one end and a knob on the other in conjunction with a bearing in the cover produces accurate linear motion so that a grinding wheel can be dressed. The reciprocating V member may accomodate a dovetail slide fixture facilitating the sharpening of micro size drills. The V clamp double V arrangement is utilized for resharpening large drill bits.

Another accessory consists of a cylindrical socket whose female bore accomodates workholding collets. The socket has a series of holes about the circumference. A pin in the cover enables indexing of the part. Outboard beatings permit spin grinding of a workpiece.

A motor may be mounted atop the cover.

A series of blocks may be assembled with the aid of a male V member to create a lathe for center drilling workpieces. The tailstock member traverses along the male V by means of a cover bearing and lever actuated rack and pinion.

A gear train, bearings (-supporting a live shaft), and a motor may be employed to allow centerless grinding of workpieces.

The tangent pin clamping concept may be employed with a V shaped quill in the tailstock of a lathe.

DESCRIPTION OF THE DRAWINGS

FIG. 14 is a perspective view of a V fixture with a modified bearing cover and a length of filler V member set up for dressing a grinding wheel.

FIG. 14A is a partly exploded perspective view of the fixture modified to punch parts.

FIG. 14C is an end view of the dovetail fixture of 14B with the end cover removed.

FIG. 14D is a top elevation view partly in section of the end cover and lead screw of the dovetail slide fixture.

DESCRIPTION OF INVENTION

Figure 1:
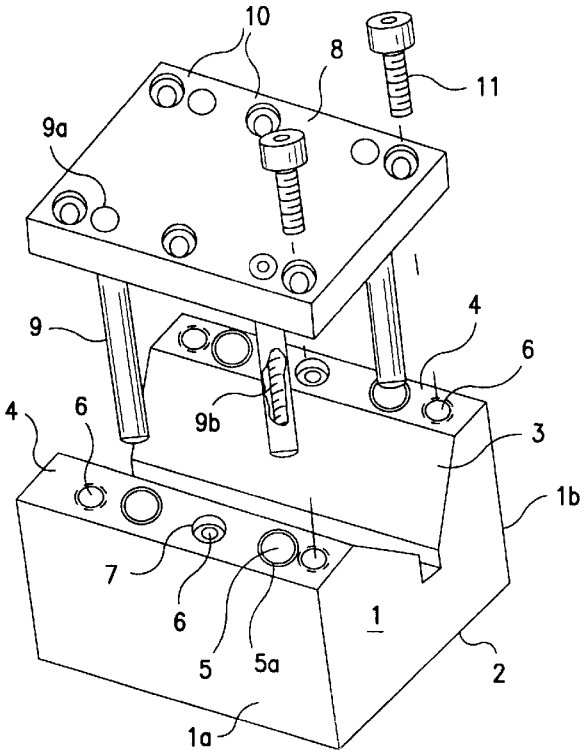
FIG. 1 is an exploded perspective view of the V block and tangent clamp embodiment of the invention.
Figure 4:
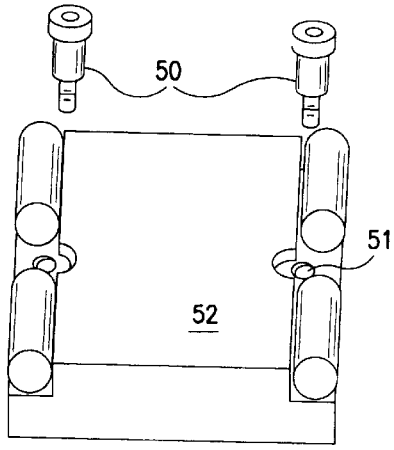
FIG. 4 is an end perspective view of a Y axis sine bar base.
Figure 5:
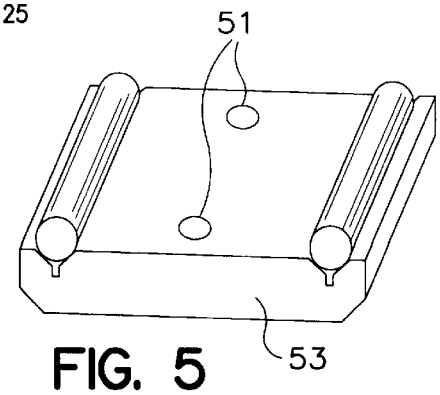
FIG. 5 is a side perspective view of an X axis sine bar base.

Referring now to FIG. 1, there is shown an exploded view of the preferred embodiment of the invention. The V block portion is generally indicated at 1 and the tangent clamp portion which secures the work is shown at 8. The V block portion is preferably made from cast iron but may be made from other suitable material (cold rolled steel or even hardened tool steel). The clamp portion may be made from mild steel or (oil) hardening steel left in the soft condition. It is preferred to construct the device from nonhardened machinable material. The advantage of this is that the end user may modify either member to facilitate a particular job. The V block fixture 1 has a single V cutout section 3 on one side and a flat base 2 on the opposite side. The V section 3 is parallel to base 2 and the V section is equidistant from sides 1*a* and 1*b* and preferably made to a common dimension. For example, the block could be made to exactly a 2.000" dimension. The vertex of the V and the center of the workpiece are then exactly 1.000" from either side. The V block fixture 1 has a land 4 on either side of the V, sufficiently wide to accomodate a series of holes. Depending on the block dimensions, there are two or more (typically four) reamed thru holes that are a close tolerance clearance fit for pins 9 of tangent clamp 8. In addition there are a series, typically six, of thru threaded holes 6. Two of the threaded holes are accurately counterbored at 7 concentric with threaded hole 6. These counterbored holes which are provided on the top and bottom of the block serve to accurately locate accessories to the block. For example the sine bases in FIGS. 4 and 5 are secured to the V block by means of a shoulder screw 50.

The clamping arrangement for securing the work to the V fixture is shown at 8. The tangent contact clamp is a flat plate having a series of holes that match the holes in block 1. The counterbored or countersunk holes at 10 match the threaded holes 6 on V block 1.

The holes 9*a* accomodate pins 9 which may be press fitted, brazed, loctited or otherwise secured to plate 8. These pins are preferably hardened dowel pins. They may be shorter, equal or longer than the thickness of the V block. Their location corresponds exactly to reamed holes 5 in block 1. Additionally both the pins and reamed holes 5 are precisely perpendicular enabling the plate to be secured on either side of the block as in FIG. 1 and FIG. 6. The plate adjusts up and down within its range to accomodate varying size workpieces. The plate and the work is secured to the V block 1 by means of socket head screws 11 (only two of which are shown) or flat head style screws. This arrangement generates enormous clamping force securing the workpiece for heavy machining, yet it will not mar the workpiece.

The overall dimension of the length and width of the plate 8 is slightly less than the block 1 itself preserving the use of the block as the datum surface. It will be noted that the tangent plate clamping arrangement enables the fixture to be held on any side thus parts requiring features 90 degrees apart can be achieved by turning the block on each side (albeit with an offset in position). Additionally some operations are better performed holding the part and the block upside down—for example sharpening the face angle on a boring tool. It will also be noted that in a more conventional mode, the tangent clamp provides a low profile as the clamp does not project more than ¼" (typical cover thickness) above the workpiece. And if necessary, additional clearance can be created by machining a bevel in the cover. Thus tasks may be accomplished that cannot be achieved with other workholding devices because of (steric hinderence) tool interference. This arrangement in which the clamp does not project more than ¼" above the work is preserved by the use of V-W type adaptors or magnetic parallels seen in FIG. 2 (20) and FIG. 7 (25, 26) respectively. As the tangent plate will not grip a part of some minimum diameter that does not project above the surface of the block, the use of either the magnetic parallels or the V-W adaptor elevates smaller diameter parts so they can project above the surface of the block for clamping, and they maintain centrality. Additionally the V-W adaptor may be inverted to hold an even smaller range of diameters.

It will also be noted the tangent contact clamping arrangement enables holding multiple parts for machining.

Figure 8:
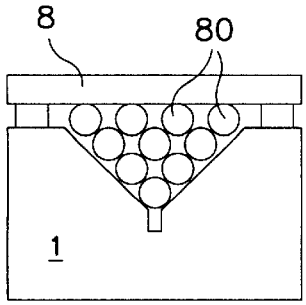
FIG. 8 is an end view of a V fixture holding multiple workpieces.
Figure 7:
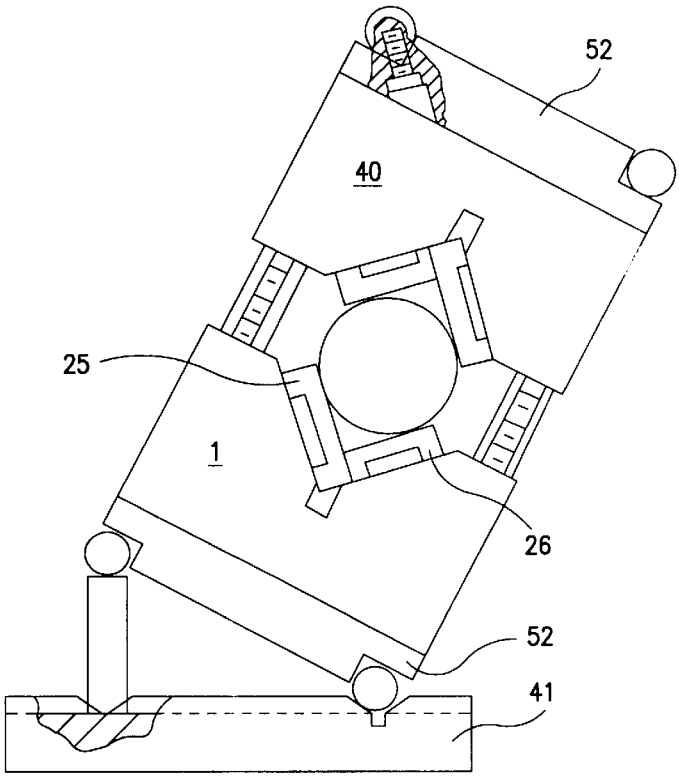
FIG. 7 is an end view of a V block and alternate V clamp embodiment. Also shown are two magnetic parallels, two sine bases and a sine base locator.

Seen in FIG. 8 is the fixture holding ten round workpieces 80 for machining to length. It should be noted that the workpieces do not necessarily have to be the same diameter or even the same geometry, for example as seen in FIG. 7 the fixture is in effect holding the rectangular magnet parallels and a round part.

Figure 9A:
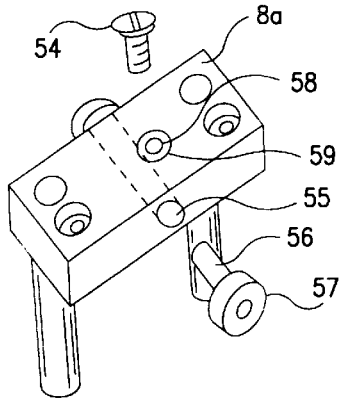
FIGS. 9 A, B, C are perspective views of partial length tangent clamps with 9A and C having modifications to accept ball bearings.
FIG. 9D is a partly exploded perspective view of the fixture set up to generate a radius on a tool bit using a pivot plate and cantilevered half clamp.
Figure 9B:
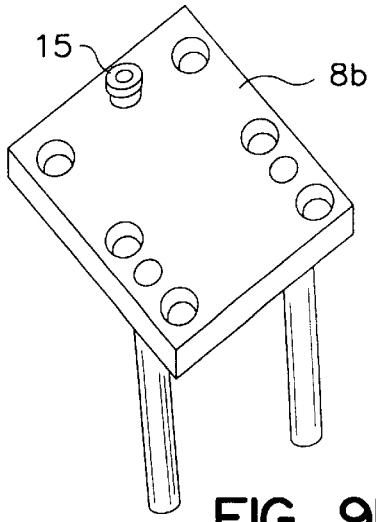

Partial clamps as seen in FIGS. 9A,B,C, may be utilized to accomodate headed and irregular workpieces. For example the quarter clamp FIG. 9A can accomodate a dumbell shaped part in conjunction with a shortened V-W adaptor. The half clamp shown in FIGS. 9B, 8*b* may be reversed to cantilever over the V block fixture and a drill bushing 15 or a stop may be incorporated into the clamp.

Figure 9C:
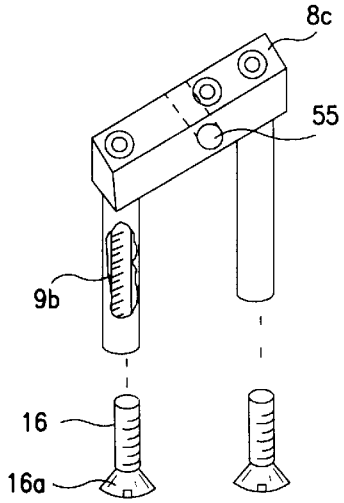
Figure 9D:
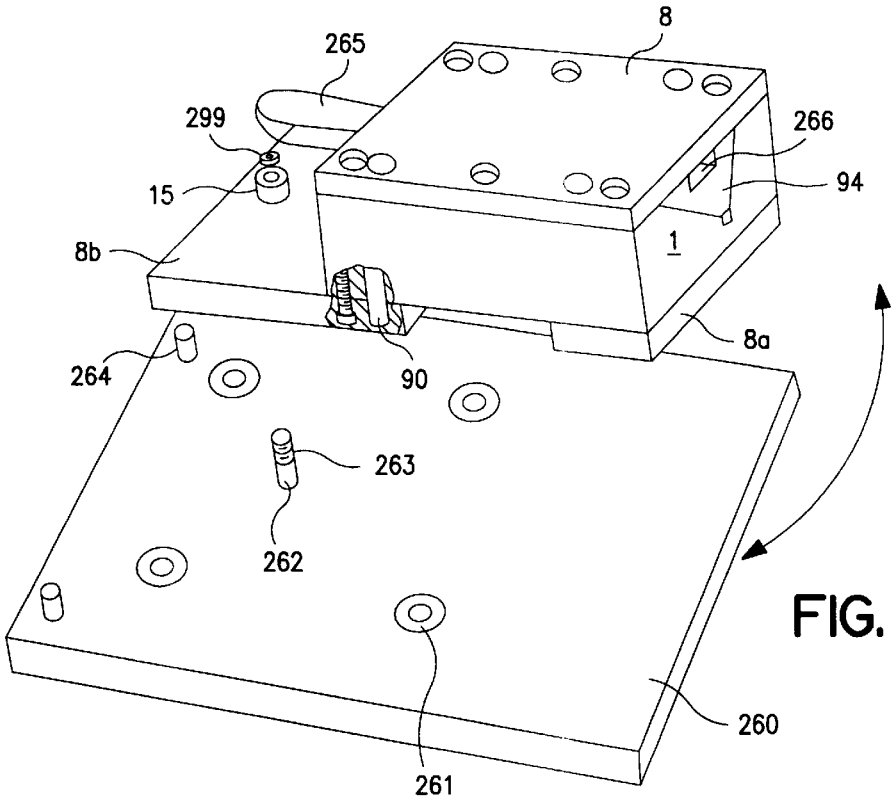

Another application of the ½ clamp is shown in FIG. 9D. Here the clamp is affixed cantilevered to the bottom of V fixture 1 and the work secured on the top side. The drill bushing 15 is the plain type and is pressed thru so it projects from the bottom side of the clamp. Pins 9 and screw 11 are replaced with short lengths and the top cover also uses shortened pins because of the shared arrangement of threaded and thru bored holes 5 and 6. A ¼ clamp 8*a* is affixed to the back bottom portion for stability again using shortened pins 9*s* and screws. The V assembly is then used in conjunction with a pivot plate 260 having countersunk thru drilled mounting holes 261 and a stud 262 which is partially threaded 263 and is secured in plate 260. The stud is a close fit for the I.D. of drill bushing 15 and is sufficiently long so the threaded portion projects beyond bushing 15. The V fixture and pivot plate are then secured by means of an elastic nylon nut 299 which will lock the nut's position and degree of tension between the two components. The pivot plate may be secured to a sine plate by means of countersunk holes 261. The sine plate may be set to the desired angle and the V fixture can now pivot about the stud pins axis so that a radius can be created on a tool or a dulled edge resharpened. The fixture can rotate about stud pin 262 until it encounters stop pin 264 in either direction. This limits tool rotation to 90 degrees in either direction The extent the workpiece 265 projects beyond the center of stud pin 262 determines the radius that will be generated on the tool. This embodiment is used on a surface grinder using a cup type wheel. A full radius form tool can be created for a lathe tool bit for example. In FIG. 9D a male V member 94 is modified by milling a channel 266 down its center to accomadate the square tool and orient it with the proper attitude.

The bikini clamp shown at 8*c* FIG. 9C eliminates the portion of the clamp for counterbored holes 10, providing additional tool clearance. The workpiece is secured by drawing the clamp down against the work by means of flathead screws 16 that screw into internally threaded thru holes in pins 9*b*. The screw head 16*a* seats flush in countersink 5*a* of reamed hole 5 preserving the ability to turn the block on any side. The tangent clamp 8 in FIG. 1 and clamps 17, 18 FIG. 2, may also be equipped with internally thru threaded pins 9*b* as well, eliminating the need for screws 11 which then permits a workpiece to be banked against the pins to insure squareness.

Any of the tangent clamps shown in FIGS. 1, 9A, 9B, 9C, may be constructed of clear acrylic or other suitable clear material to provide a "window-clamp" which facilitates unencumbered inspection of workpieces on an optical comparator.

Figure 2:
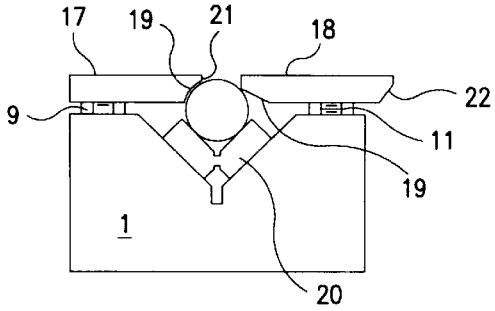
FIG. 2 is an end view of the V block equipped with keyway clamps and V-W adaptor
Figure 3:
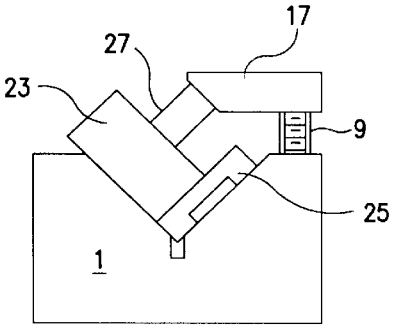
FIG. 3 is an end view of the V fixture and a single keyway clamp holding a workpiece.

An alternative means of holding workpieces in V fixture 1 is shown in FIGS. 2 and 3. Keyway clamps 17, 18 are used either singly FIG. 3 or in pairs FIG. 2 to hold a workpiece. Holding a part 23 as in FIG. 3 enables drilling the part at ½ the included angle of the V or to produce a chamfer or bevel on the workpiece. Work held with a single keyway clamp is often done so thru the use of an intermediary 27 and magnetic parallel 25.

The keyway clamp shown at 17 runs the length of the V block fixture, and has two pins 9 that correspond to the reamed holes 5 in block 1. In addition there are also three thru counterbored holes that correspond to threaded hole 6 in block 1. As can be seen in FIG. 2 keyway clamp 17 has a beveled edge 19 which terminates somewhat short of edge 21 to avoid a sharp easily damaged edge. It is beveled edge 19 that makes contact with the work. Clamping force is exerted by screws 11. Countering the angular force of keyway clamp 17 is keyway clamp 18 which provides an opposite angular force to hold the work down and central within the V fixture. These style clamps provide unencumbered access along the axis of the workpiece for milling a keyway, a flat or drilling holes along the length of the part.

Figure 6:
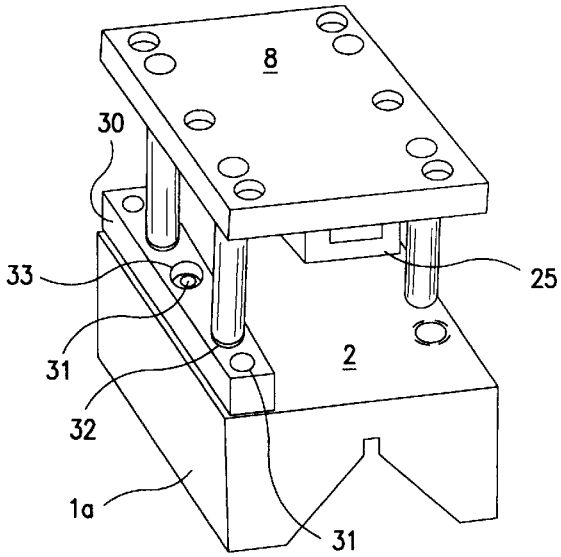
FIG. 6 is a perspective view of a V fixture utilizing the clamp on the bottom side in conjunction with a fence and magnetic parallel.

Shown at 22 is an additional bevel opposite bevel end 19 of keyway clamp 18. Relative to pin 9 it will be noted that the dimension to the edge of the clamp is unequal to the opposite edge. This keyway clamp is reversible, by tuning the clamp end for end and reinstalling it in the block, it will accomodate a larger range of diameters and/or exposes more of the workpiece for machining without having to modify a clamp. All the clamps previously described may be utilized on the bottom side 2 of V fixture 1. As seen in FIG. 6 this side of the block is used to hold rectangular or planar parts in the same orientation as the base. A fence 30 may be utilized to align parts, shorter than the pin spacing, parallel with the edge of side 1*a* of the V block. Fence 30 runs the length of the block and has a series of clearance holes 31 and 32. Holes 31 corresponding to threaded holes 6 in V block 1. Holes 32 correspond to reamed holes 5 in V block 1. Counterbore 33 enables the fence to be secured to V block 1 by means of a short socket head cap screw. As the tangent clamp 8 cannot close below the thickness of fence 30, a magnetic parallel 25 is used to facilitate clamping of thin parts when using the fence.

Another clamping embodiment of the invention utilizes the V clamp 40 FIG. 7 instead of tangent clamp 8 FIG. 1. The V clamp 40 is made to the same dimensions as V block 1. The difference is the holes in the block. The holes correspond exactly with the holes in V block 1. However holes 6 are instead clear holes for screw 11 and the base side 2 of the clamp is counterbored to recess the head of screws 11. And reamed holes 5 are instead made a press fit for dowel pins 9 which project the thickness of block 1. The double V arrangement is particularly well suited to the production of parts with symetrical features. Additionally the double V arrangement enables the resharpening of large diameter drill bits on inexpensive grinders having a tilting table and mitre gage. One only need orient the cutting edges in the block and set up a stop so that both lips are ground equally.

Figure 5A:
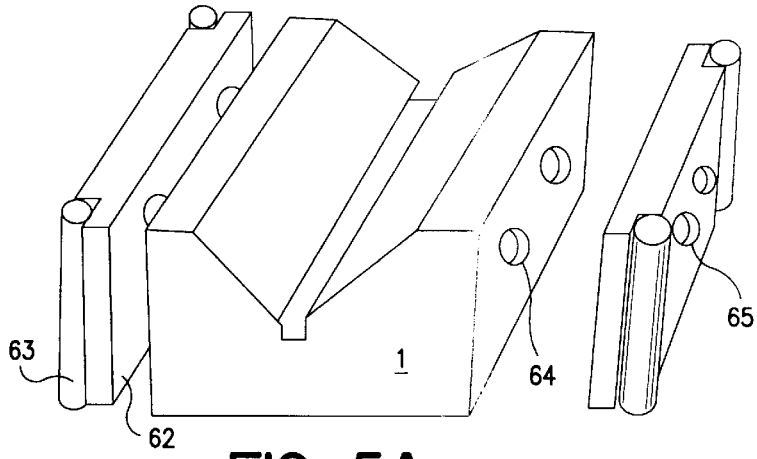
FIG. 5A is an exploded perspective view of a V fixture and two Z axis sine bases.

In FIGS. 4 and 5 and 5*a* are shown accessory sine bar bases well known in the art. The sine base 52 illustrated in FIG. 4 permits tilting the base along the y axis. The embodiment 53 shown in FIG. 5 permits setting angles along the x axis. Either sine base is secured to either side of V block 1 by means of precision shoulder screws 50 that locate in counterbore 7 and are a close fit to thru hole 51. The y axis sine base may be used to alter the angle produced in milling or drilling a part held as shown in FIG. 3.

The sine base 62 in FIG. 5*a* has the sine rolls 63 oriented in the z axis. This sine base attaches to the side of fixture 1 by means of counterbored and threaded holes 64 which correspond to reamed and counterbored locating holes 65 in sine base 62. This particular sine base is used in pairs and can produce symetrically angled features without using the double V clamping arrangement, or may be used to set a compound angle in conjunction with sine base 53.

While the V block configuration is essentially limited to producing features 90 degrees apart, utilizing the y axis sine base on both sides of the double V arrangement as seen in FIG. 7 is not. If used with a sine base locator 41 set against a stop, it will allow the production of triangular, pentagonal, hexagonal, octagonal, or other polygonal features by selective gage block settings and turning the blocks so alternate rolls are at the vertex of the angle.

Figure 11:
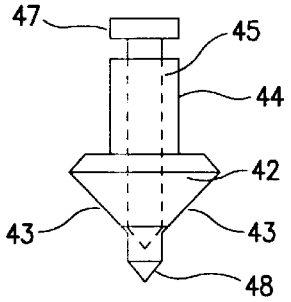
FIGS. 11 and 11A is an end and side view respectively of a spindle positioning center finder.
Figure 11A:
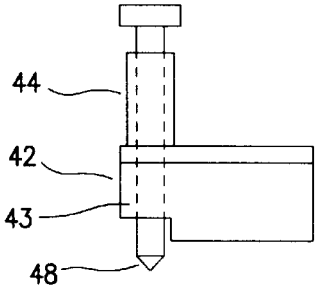

Another accessory to the tool is a spindle/center alignment tool as seen in FIGS. 11 and 11*a*. The center finder is comprised of a triangular section generally indicated at 42. The inclined surfaces 43 are the same angle as V cutout 3 in V block 1. The sides are oriented to engage the V block when held by cylinderical chuck portion 44 which is press fitted in the center of body 42. Chucking portion 44 has a concentric thru hole that extends completely thru body 42. Headed pin 47 is a close tolerance fit for bore 45. Opposite the headed end of the pin is a conical concentric end 48.

The tool is used as follows: chucking portion 44 is secured in a drill chuck typically on a drill press; The V block position is approximated by eye under the spindle; The quill is brought down until sides 43 engage the V block surface 3. Continued downward pressure forces the V block to align directly under the spindle. It is preferred that conical end portion 48 remain outside of the block. The V block itself may be mounted on magnetic bases, which may then be energized, securing the V block directly under the spindle. The workpiece is then placed in the V block, the tangent cover installed, and the screws snugged up. The conical end 48 of headed pin 47 is then brought down to the workpiece and aligned with a scribed line on the workpiece. This finds the axial location. The screws 11 are tightened, the center finder replaced with the appropriate drill(s) and drilling proceeds.

The entire operation can be accomplished in less than a minute and a cross drilled hole potentially on the centerline of the work within 0.0005" can be accomplished by unskilled labor.

Figure 12:
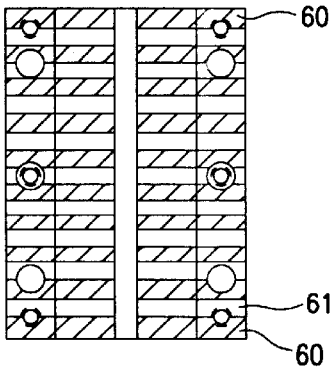
FIG. 12 is top elevation view of a laminated embodiment of magnetic and non-magnetic material of the version shown in FIG. 1.

Another embodiment of the invention is shown in FIG. 12. This embodiment is constructed of laminated sections of brass 61 and steel 60 (or non-magnetic stainless steel and steel) layered in an alternating sequence with the lamination starting and ending in the steel layer 60. The laminations are preferably brazed together. Other than the laminated construction the embodiment is identical to the embodiment in FIG. 1. The advantage of this embodiment is that it offers an additional means of holding a workpiece. Used on a magnetic chuck of a surface grinder the block and a ferrous part will be held magnetically for unrestricted grinding of a workpiece.

Figure 13:
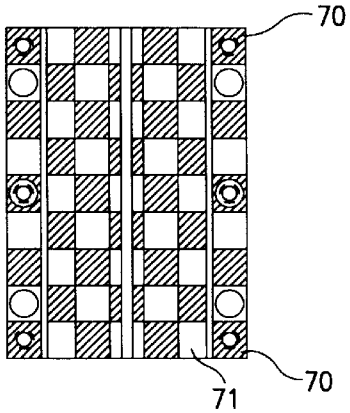
FIG. 13 is a top elevation view of a laminated checkerboard V block embodiment.

Another variation of this embodiment is shown in FIG. 13. This version also features laminated construction of ferrous 70 and nonferrous 71 material. These laminations are essentially square members with the steel members on the corners. The members are preferably brazed together.

Other than the construction of the block the fixture is identical to the embodiment in FIG. 1. This embodiment also serves to hold work magnetically like a magnetic parallel as does the embodiment in FIG. 12. The advantage of this embodiment over that shown in FIG. 12 is that it will hold a ferrous part regardless as to how it is placed on the chuck. With the embodiment in FIG. 12 the laminations must be aligned with the poles of the chuck for the magnetic force to pass thru. The checkerboard arrangement is indifferent to its position on the chuck.

Still another use of the fixture is shown in FIG. 14. Tangent clamp 8 is modified by milling a longitudinal thru slot 90 along the centerline, The slot 90 accomodates a bearing 91 mounted on an axle 92. The axle is secured by two bearing mounts 93 secured to the cover 8. The bearing is large enough so that a protion protrudes below the bottom surface of plate 8. The beating makes contact with a length of a V filler block 94. Screws 11 are snugged enough so that the bearing will roll when the filler V block is reciprocated by pushing on knob 95 that is threaded into filler V 94. Opposite knob 95 end is a diamond dressing tool 96 secured in cross drilled hole 97 by means of a set screw in intersecting threaded hole 98. Using this embodiment in conjunction with the sine base shown in FIG. 5 enables dressing angular forms onto a grinding wheel.

Figure 14B:
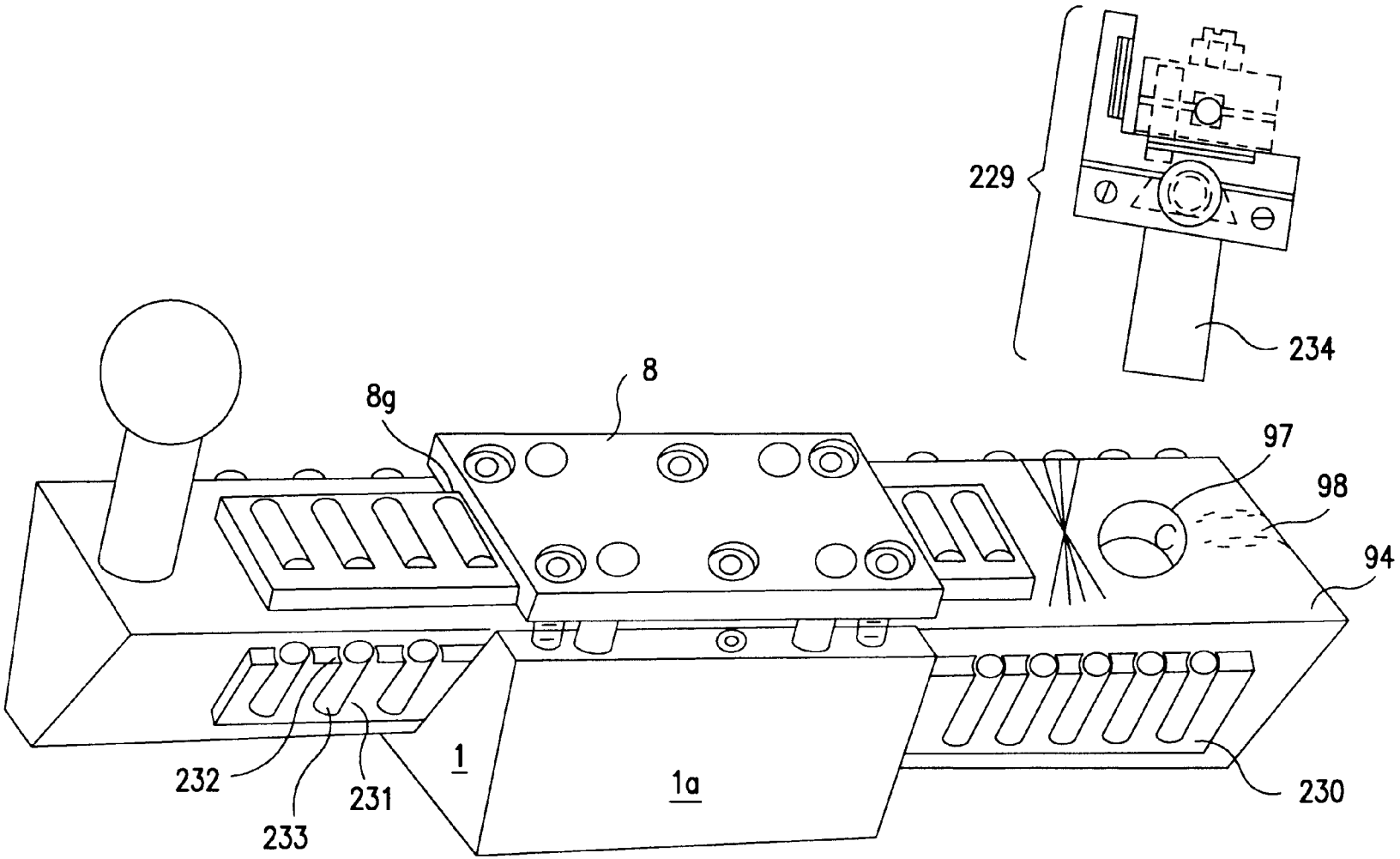
FIG. 14B is a partly exploded perspective view of the fixture utilizing a male filler V with caged roller bearings and a dovetail fixture to facilitate sharpening small drills held in a drill fixture (indicated as a phantom).

Another application for the reciprocating male V is shown in FIG. 14B. Another bearing embodiment is shown utilizing caged roller bearings. The roller cage 230 may be machined from brass or molded from plastic. The U shaped openings 231 have sides with the contour of the bearing 232, and house the roller pins 233. A roller/cage beating assembly may be employed on the three sides of the V. The bottom surface of cover 8 has a milled slot 8*g* slightly larger than the bearing assembly to track it. The top bearing cage may also have a strip of material closing the U retaining the rollers. This roller bearing embodiment has very low friction and rolling resistance. In this case male V 94 is equipped with another accessory, a dovetailed slide assembly 229 which accomodates drill sharpening fixtures of the type disclosed in a previous U.S. Pat. No. 6,031,156 for resharpening small diameter peck drills. As the permissable error is very small when working with very small diameter drills 0.005"–0.015", the reciprocating male V imparts very accurate motion across the grinding wheel while the micrometer type feed of the dovetail slide minutely advances the tool controlling the depth of cut.

The dovetail slide, preferably constructed from brass or steel consists of a shank portion 234 which is sized to fit in mounting hole 97 in male V member 94 instead of the diamond dressor. The shank may have an annular groove 235 corresponding to the position of set screw 98. Therefore any "bite marks" on the shank will not interfere with installation or removal of the part. The shank is pressed into a length of rectangular stock 236 which then has a female dovetail 237 machined in it. Threaded holes 238 are provided on one end of the rectangular member 236 on either side of the dovetail. An L shaped dovetail member 239 has a male dovetail 240 machined on its underside. It is a precise fit for the female dovetail 237 in the lower member. Additionally the male dovetail 240 is internally threaded 241 at least partway thru its length. An end cover is secured to one end of the dovetail assembly by screws 243 that pass thru holes 244 matching the threaded holes 238 in the female dovetail member 236. The end cover 242 also has a thru hole 245 corresponding to the internally threaded hole 241 in male dovetail 240. This hole 245 accomodates a fine pitched screw 246 that has a portion of the screw 247 turned down below its root diameter. A knob 248 having graduations is secured to portion 247 that extends thru end cover 242 by means of set screw 249. As screw member 246 can only rotate, dovetail member 239 will advance or retract according to the direction the knob is turned. The top portion of the L shaped dovetail member 239 may have a milled slot running the length of the part as may the L shaped portion 251. A strip of magnetic tape 252 of the type used on the magnetic parallels 25, 26 is secured in the groove 250, 251. In addition both surfaces may have a reamed hole to accomodate the alignment pin (a longer pin is used) of the drill sharpening fixture disclosed in a previous U.S. Pat. No. 6,031,156. The L surface may have additional clearance holes and the surface opposite the dovetail may have additional threaded holes to accomodate other fixtures. The L fixture allows mounting the sharpening fixture on its side to grind the negative rake knife edge along the relief edge for the drill geometry discribed in U.S. Pat. No. 6,031,156.

When the shank 234 is secured in male V 94 the dovetail assembly projects beyond the side edge 1*a* of fixture 1. The fixture is used on a grinder having a tilting table. The mitre setting is accomplished by rotating the dovetail assembly in male V 94. Lines may be scribed on the male V to indicate various angle settings. The table is tilted resulting in a compound angle for producing the drill point cutting edge. The V fixture 1 is positioned in proximity to the grinding wheel with its side edge 1*a* parallel to the wheel. A magnetic base is then used to secure the fixture stationary in this position. The micrometer knob advances the tool into the grinding wheel for resharpening the edge. And the male V member is reciprocated back and forth to grind the surface of the tool.

The filler V block 94 will find other uses as well, as the filler block can be repeatedly relocated in the V block Odd parts can be accomodated by machining or e.d.m.ing a cavity in the filler block, as may the cover 8, on its underside. Thus the tool may be used to form small malleable parts from sheet metal or plastics with the aid of an arbor press. To facilitate odd parts for drilling, the filler block cavity may locate the part and an elastomeric vise jaw liner, with magnetic backing may be used on the underside of the cover 8 to conform to irregularities of the part.

Another application of the fixture shown in FIG. 14*a* is punching parts. This is accomplished by modifying tangent plate cover 8 and die plate cover 66 which is secured to the V side of fixture 1. In the center of die plate cover 66 a hole 67 is made for the particular size required. The die cover 66 is secured to the center threaded holes 6 of fixture 1 by means of socket screws, which are accomodated by counterbored thru holes 72. The remaining holes 73 in die cover 66 correspond to holes 5 and 6 in fixture 1 but these holes are oversize clearance holes. The tangent plate cover 8 is then installed, secured, and drilled/reamed 68 at the same coordinates as die hole 67 and a punch 35 is then secured in cover 8. Thin sheet metal or plastic parts may then be punched with the aid of an arbor press. Springs 69 may be employed on the pins 9 to return the cover 8, and a stripper plate 34 installed over the punch 35 is secured by shoulder screws 36 that thread into the stripper plate 34 thru holes 37 in the cover 8. The stripper plate is also spring loaded, to facilitate removal from the part. The die cover 66 is generally used with the fence 30 to guide the workstrip into the fixture. Small discs, washers, or other shape parts can be produced in this fashion.

Figure 15:
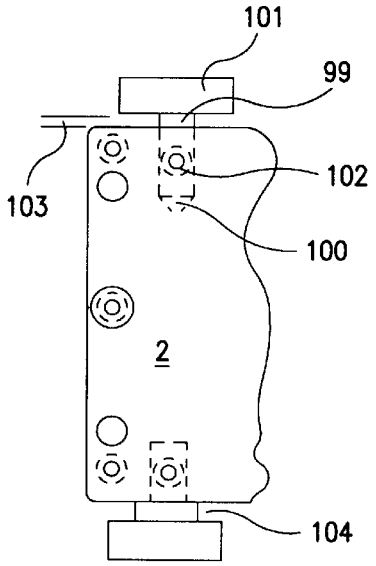
FIG. 15 is a segmented elevation view of the bottom of the V block fixture modified to accept outboard bearings.

Another modification to the V block fixture shown in FIG. 1, that extends its usefulness, is seen in FIG. 15. Here V fixture 1 is modified by the addition of drilled holes 100 into the face of either side of the block. The holes are drilled at equal and opposite coordinates. The holes 100 accomodate the axle shaft 99 of ball bearing 101. The ball bearing is secured in intersecting cross drilled thru threaded hole 102. The set screw locks the shaft and allows the outer race of ball bearing 101 to rotate about the shaft. The depth of hole 100 is drilled slightly less than the length of axle 99. This creates a slight space between bearing and block so that the bearing will turn freely. Alternatively the axle shaft may be stepped at 104 so the bearing will turn freely.

Figure 16:
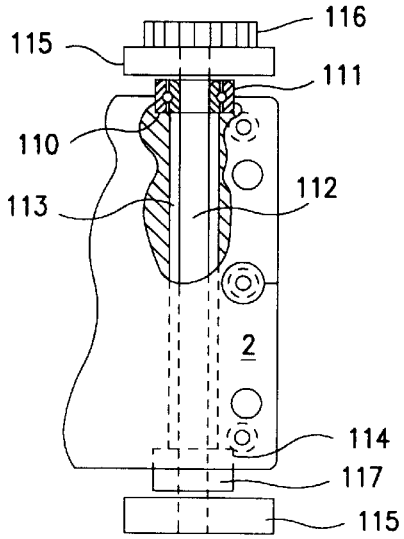
FIG. 16 is a segmented elevation view partly in section of the bottom of a V fixture modified to accept live spindle outboard bearings.

A variation of this modifications is shown in FIG. 16. In this case a seat 110 is bored into V block 1. It is a press fit for the outer race of bearing 111. Axle shaft 112 extends completely thru V block 1 in an oversize hole 113. At the opposite end of the V block is another bore 114. This accomodates a second bearing 117. This bore may be a press fit for the bearing as well if done accurately. However, to lessen the degree of accuracy required, the bore may be oversize. The bearing's position floats in the bore aligned by shaft 112. Its position may then be fixed by the application of loctite.

Pressed into either end of shaft 112 are drive discs 115. Shaft 112 is a mild press fit for the inner race of bearing 110 and 117. This outboard bearing features a live shaft which may be motor driven thru spur gear 116 which is also press fitted onto shaft 112.

The outboard bearing modifications shown in FIGS. 15 and 16 are also preferably used with a modification of tangent clamp 8, 8*a*, 8*c*. A hole 55 is drilled into either end of clamp 8 or thru the clamp as in FIGS. 9A and 9C. This hole is on the centerline of the clamp. The hole is a close tolerance fit for the axle shaft 56 of bearing 57. The shaft 56 may be secured in clamp 8, 8*a*, 8*c* by means of a flat head screw 54 which is secured into partially threaded thru hole 58 which has a countersink 59 that intersects hole 55.

Figure 17:
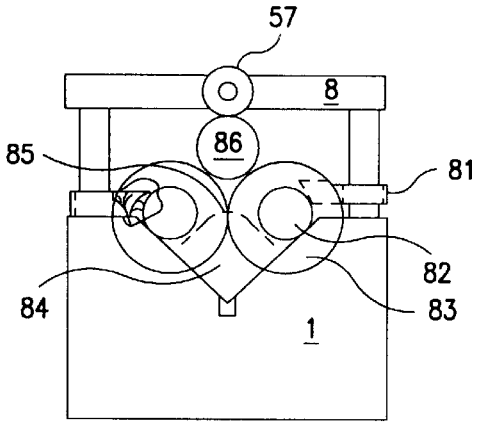
FIG. 17 is an end view of an unmodified V fixture supporting a workpiece with modular outboard bearings.

Outboard bearings may also be modular, in that no modification of V block 1 is required. Seen in FIG. 17 is a workpiece supported by modular bearings. A dedicated hold-down clamp 81 secures the axle 82 of ball bearing 83. The bearings 83 are supported and separated by square support 84. The top of square support 84 is milled at 85 to create clearance to support smaller diameter workpieces. Clamp 8 moves up and down within its range to support varying diameter workpieces, passing thru oversize holes in dedicated holddown 81.

This variation requires clamp 8 be equipped with longer locating pins 9. FIG. 17 is representative of all bearing supported work, it may be possible to omit bearing 57 and use tangent clamp 8 as the third point supporting the workpiece. As this has much higher friction, most of the tangent contact with the work should be relieved so only a fore and aft land makes contact with the work. Tapering and releaving the underside of tangent clamp 8 may be a means of regrinding the point on a dead center for example.

Figures 18, 22:
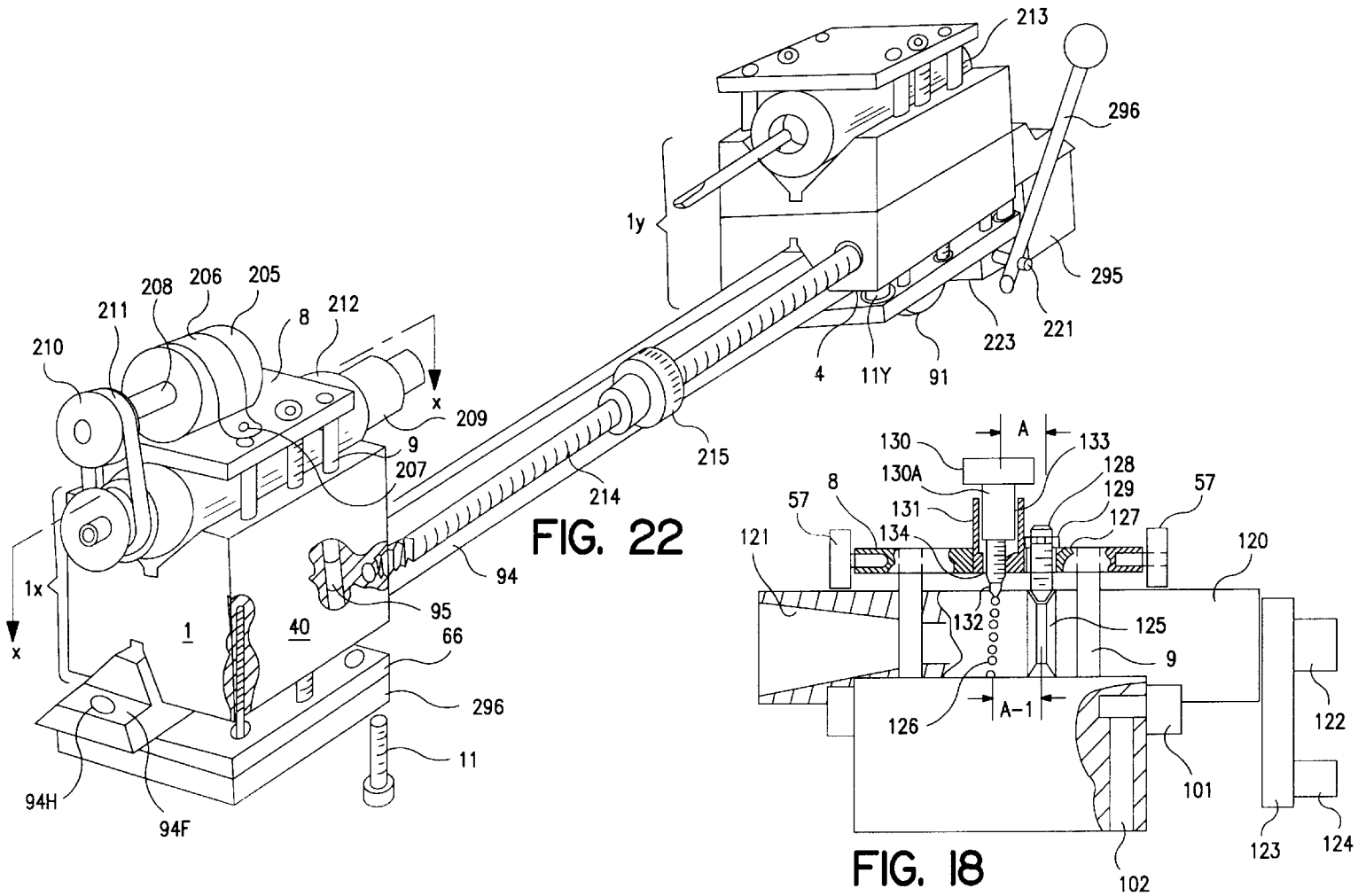
FIG. 18 is a side view partly in section of the modified fixture of FIG. 15 set up for spin indexing applications.
FIG. 22 is a perspective view of two V fixtures and V clamps and a male V member set up to create a deep hole center drilling lathe.
Figure 19:
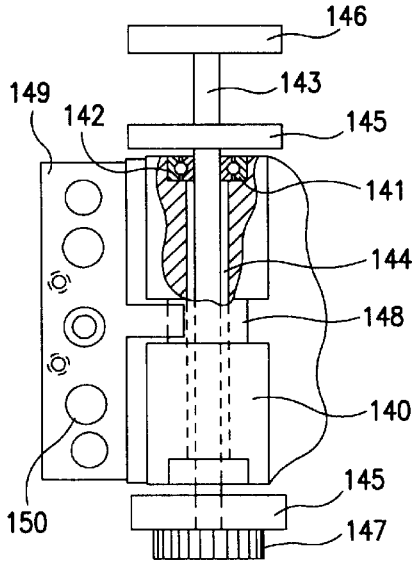
FIG. 19 is a segmented top elevation view partly in section of a modular live spindle cartridge.
Figure 20:
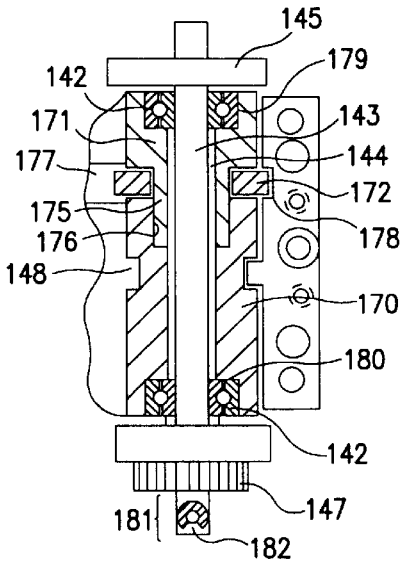
FIG. 20 is a segmented top elevation view in section of a modular live spindle cartridge bearing having an additional free wheeling idler.

The outboard bearing modifications described in FIGS. 15, 16, 17, and 9A and 9C are especially well suited to the spin indexing application shown in FIG. 18. In this case the V block 1 has been modified as in FIG. 15 and tangent clamp 8 drilled as in FIG. 9A. The outboard bearings 101 and 57 support a cylindrical socket 120. The socket is internally thru bored concentric with o.d. and is internally tapered at 121 to accept a particular type of workholding collet for example #2 or 3 Morse or 5*c* etc. The collet and the work is secured by end screw 122 which tightens the collet in the bore. End screw 122 also serves to secure crank 123 which is used to manually rotate the socket 120 and thereby the workpiece. Free wheeling knob 124 facilitates rotating the crank. The socket has a V groove ground into its o.d. Its centerline is a precise distance A1 from index holes 126. While only one row of holes is illustrated it is understood additional rows of index holes may be employed. For example, A 24 index hole row and a 10 index hole row to accomplish a greater range of division. Tangent cover 8 has two additional modifications—a thru threaded hole 127 on the centerline of the cover and locking pin 130 also on the centerline of the clamp. The centerline distance A between the holes is to the same specifications as the V groove and index holes A1 in socket 120. The axial position of the socket 120 is fixed by conical pointed screw 128. The conical point of the screw is made to the same included angle as V groove 125. Tension is adjusted on the screw against the V groove to just remove any axial play, locknut 129 is then tightened. While index pin 130 may simply be a close tolerance pin for index hole 126, it is preferred to press fit an insert 131 into cover 8 so that indexing pin 130 may consist of a modified shoulder screw. The screw is modified by turning a pilot 132 on its leading edge which is a close tolerance fit for index hole 126. Insert 131 is shorter in length than shoulder screw 130. Its bore 133 is a close tolerance fit for screw body 130*a* and the bottom portion of the insert is thru threaded for the screw thread of pin (shoulder screw) 130. The advantage of this arrangement over a simple pin is that it exerts positive screw pressure against the socket to lock its position. Shown in FIGS. 19 and 20 are two modular live spindle cartridge bearings. They may be used for the spin indexing application described above, however these components are primarily for centerless grinding applications. The cartridge bearing shown in FIG. 19 consists of a bearing housing 140 which is bored at both ends 141 to be a press fit for sealed ball beatings 142. The live spindle 143 extends completely thru the cartridge in an oversize bore 144. Pressed onto shaft 143 are outboard drive discs 145. They are larger in diameter than the cartridge bearing 140. An additional drive disc 146 may be pressed on an extended length of shaft 143. The diameter of this disc may be 0.001–0.002" larger than drive disc 145. The grinding wheel is positioned between these discs and the diameter reduction of the workpiece takes place here. The far outboard disc offers support to the workpiece as it traverses past the grinding wheel. Setting the block at a slight angle off perpendicular will cause the grinding wheel to impart linear motion to the work. Rotary motion is imparted to the work thru a spur gear 147 pressed onto the end of shaft 143. This gear diameter is smaller than drive disc 145. A motor driving the spur gear will simultaneouly turn all the drive wheels on the train. The rotation of the work should be in the same direction as the grinding wheel so the grinding wheel will assist in keeping the work rotating.

Figure 10:
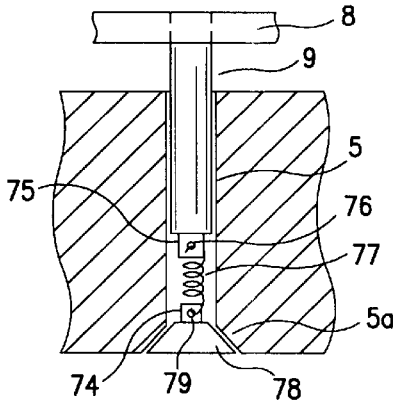
FIG. 10 is a segmented cross sectional side view of a tangent clamp retained in the V block by a spring bias.
Figure 10A:
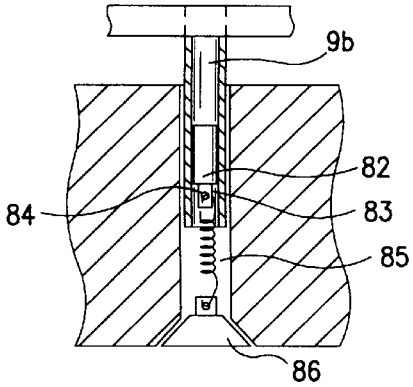
FIG. 10A is a segmented cross sectional side view of a tangent clamp retained in the V block by an adjustable spring bias means.

An annular groove 148 in the housing 140 aids holding the cartridge in the V block by means of dedicated clamp 149. Locating pins 9 of tangent clamp 8 pass thru oversize holes 150 in the cartridge clamp 149 to allow adjustment. The rotary motion imparted to the work by drive discs 145 is easily stalled by too little or too much tension on tangent clamp 8. To eliminate constantly adjusting clamping screws 11, an alternate means of creating tension on the work is seen in FIG. 10 and FIG. 10*a*. In FIG. 10 locating pin 9 of tangent clamp 8 is modified by turning a smaller diameter 75 at the end of the pin. A thru hole 76 is made on the centerline thru the turned diameter. An extension spring 77 is hooked thru hole 76. At the bottom of reamed hole 5 is flat head plug 78, it sits recessed in countersink 5*a*. The flat head plug also has a straight reduced diameter portion 79 thru which a hole 74 is drilled. The opposite end of spring 77 hooks thru and is retained by hole 74. The pin length 9 and spring 77 have to be set for a particular size range of workpieces. The embodiment in FIG. 10*a* utilizes thru threaded locating pin 9*b*. Set screw 82 has a portion turned down on its end 83 which has a thru hole 84. Extension spring 85 is secured in the hole. A flat head plug 86 retains spring 85 as with the previous embodiment. Its diameter must be small enough to fit thru the threaded hole on pin 9*b*. This version has the ability to adjust the spring tension by turning set screw 82 up or down pin 9*b*. It will accomodate the full range of the clamp, however, the spring it utilizes is not potentially as strong as the spring used in FIG. 10.

Shown in FIG. 20 is another live spindle cartridge bearing. Like the previous embodiment it has bearings 142 at both ends of cartridge housing 170. The live spindle 143 extends thru the cartridge and end beatings 142. The shaft 143 passes thru an oversize hole 144 in the cartridge. Drive discs 145 and spur gear 147 are also pressed into the shaft so they will turn in unison with the shaft. Excluding the bearings the cartridge consists of three pieces 170, 171, and a free wheeling idler roller 172. Cartridge 171 has a concentric shoulder turned down to accomodate idler roller 172. The o.d. of the shoulder 175 is a close tolerance clearance fit for the i.d. of the idler 172. Bore 176 is a press fit for shoulder 175. The depth of bore 176 and the length of shoulder 175 is carefully controlled so that upon pressing the components together it will not squeeze free wheeling idler 172. Because the diameter of idler 172 is larger than the cartridge body it requires V block 1 be modified with groove 177 along surface 3 to clear the idler. Likewise dedicated cartridge clamp 149 also has a cutout 178 to clear idler 172. Cartridge 170 may also have a annular groove 148 to aid in holding the cartridge in the block 1. One of the bearing bores 179 should be a press fit for bearing 142, the other may be an oversize bore 180 into which the bearing will float and is aligned by the shaft 143. Upon assembly the addition of loctite or other adhesive compound will secure the bearing in place. Shaft 143 may extend beyond drive disc 145 and spur gear 147 at either end 181 and the shaft may have center holes 182 drilled at either end. This facilitates the turning and/or grinding of the drive wheel 145, idler 172 and cartridge body 170 and 171 between centers so the components are concentric with line spindle shaft 143 correcting any errors produced by assembly.

The cartridge embodiment in FIG. 20 is employed with partial tangent clamp 8*a* shown in FIG. 9*a*. The advantage is that shorter length workpieces may be centerless ground, as there is additional support to the work. The drive disc rotates simultaneously thru spur gear 147, this rotates the work. The revolving workpiece then rotates rear bearing 57 and idler 172. Grinding may take place between partial clamps 8*a* or outboard of V block 1.

Figure 21:
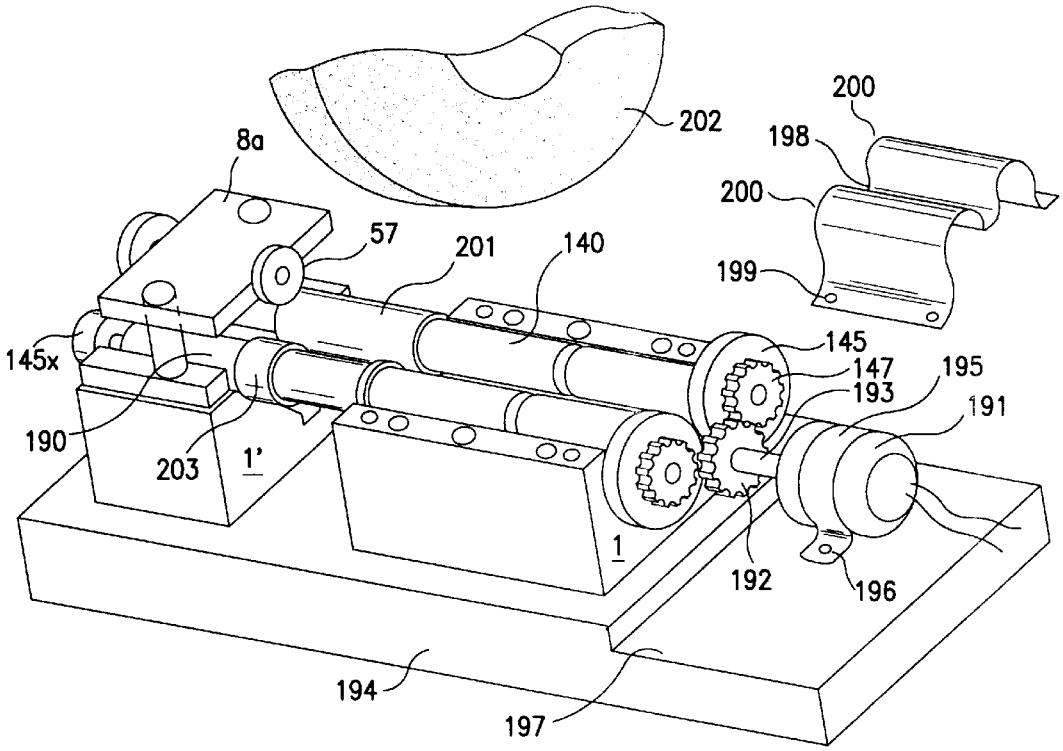
FIG. 21 is a perspective view of a common plate mount and cartridge bearing of FIG. 19 in a partially assembled V fixture with a motor driving the live spindle thru the gear train and with an extended spindle and cartridge supported in a second V fixture set up for centerless grinding of cylinderical work on a surface grinder.

In FIG. 21 is shown a V block fixture set up for centerless grinding on a surface grinder. The embodiment in this case employs the modular cartridge bearing of FIG. 19 which has been further modified to provide greater outboard support thru the use of a second shortened V block 1', extended line shaft 143 and additional cartridge bearings 190, V block 1 and 1' are ground to the same specifications as are square supports 84 (FIG. 17). The live spindles 143 are driven by a motor 191 having a spur gear 192 mounted on its drive shaft 193. This spur gear meshes with both spur gears 147 of each bearing cartridge 140 and turns the drive discs 145, 145*x*, 201 in the same direction. While the clamps 8 and work are omitted from this drawing they are supported by 3-point bearing contact as in FIG. 17.

The motor is mounted to a common plate 194 by a motor mount 195 and screws 196. V block 1 is mounted to the plate by means of a shoulder screw 50 that seats in bottom counterbore 7 as described for sine bases in FIGS. 4 and 5. This will repeatedly locate the V block to the plate 194. Motor mount 195 has sufficient play in it to move the motor for proper gear meshing. Screws 196 are then tightened. Plate 194 may have a step in it 197 to accomodate a particular motor, insuring it is at the proper height. The outboard V block 1' may also be fastened to the plate in the same fashion as V block 1. However instead of locating shoulder screws SO (FIG. 4) regular screws 11 (FIG. 1) may be employed. In this way the block position may float so that cartridge bearings 190 will determine its position, at which time screws 11 are tightened. A shield shown exploded at 198 may be formed from sheet metal or molded from plastic or zinc. It may be employed to cover the motor and gears to minimize the amount of grit and swarf they are exposed to. The sheild is secured to plate 194 by screws thru mounting holes 199. Additionally the shield bears the same or slightly smaller profile 200 as the drive disc 145 assembly. The shield may then offer support to a workpiece as it is initially placed on the fixture and would otherwise only be supported by one pair of drive discs. V block 1 employs tangent clamp 8 with cover bearings 57. It may utilize the spring bias retention illustrated in FIG. 10 or 10*a* and/or may be secured by screws 11, and the tension controlled by snugging the screws. V block 1' utilizes tangemt clamp 8*a* and is retained by spring tension as shown in FIG. 10 or 10*a*.

The drive discs 145, 146 shown in FIG. 19 are replaced with drive rolls 201 instead. Grinding takes place over these rolls between V blocks by grinding wheel 202. The drive roll may be metallic or may be made from abrasive type regulating roll material ground concentric with live spindle 143. The drive rolls 201 may have a stepped diameter 203 equal to the depth of cut of the material removed from the work. The larger diameter of step 203 supports the reduced diameter of the work piece in conjunction with spring bias tangent clamp 8*a*. In addition the final drive discs 145*x* may also be made to the same diameter as step 203.

In another application of the tool seen in FIG. 22 two V block fixtures 1 and two V block clamps 40 are arranged and secured with the V cavities facing in opposite directions to create a center drilling type lathe. The dowel pins 9 that are normally used in the V clamp 40 are removed and replaced with short pins 9*s* that project out ½ their length from the base side of the V clamp. This locates the two blocks together. The assembly 1*x* is secured by sufficiently long screws 11 thru die cover plate 66. Assembly 1*y* is secured thru screws 11*y* that are secured against land 4 of V clamp 40. Either the bearing tangent plate has pins 9 that are ground to a smaller diameter or the V clamp pin holes are opened up to clear the standard pin size. The bearing tangent plate is secured by screws threading into the center hole 6 of the V clamp.

Needless to say, for this particular application the V blocks should be ground to the same specifications for proper alignment to be made, particularly the base to V height and the parallelism of same. Hole locations in relation to the V are also critical. When properly done the V cavities will be in very accurate alignment. Alignment between joined blocks 1*x* and 1*y* is accomplished by means of a length of male V member 94 which is preferably ground to match the V cavity of the fixture. Alternatively, top and bottom V may be aligned by undersize pins loctited in place while the V segments are aligned using two male V members 94 at which time the assembly is tightened. Once the loctite cures the assembly will thereafter be in alignment.

This assembly arrangement 1*x* may also be utilized to precisely align two or more blocks for milling keyways or other features in long shafts. The length of the male V and number of supporting blocks used are according to the length of work at hand. The appropriate keyway clamps 17 or 18 being used replacing the tangent clamp 8 shown in FIG. 22.

It may be necessary to utilize tangent or keyway clamps with shortened pins 9 s because of the dutch pin assembly arrangement joing assembly 1*x*.

Male V member 94 may protrude from the ends of assembly 1*x* and 1*y* and may have a flat 94*f* and a thru hole 94*h* to facilitate securing the components to a machine table or plate by screws or clamps. Spacer blocks 295 and 296 are used to elevate the assembly off the surface its mounted on so that bearing 91 clears the table. Alternatively the male V member may be held in a swiveling vise and the work can thus be set at an angle to the table.

Figure 23:
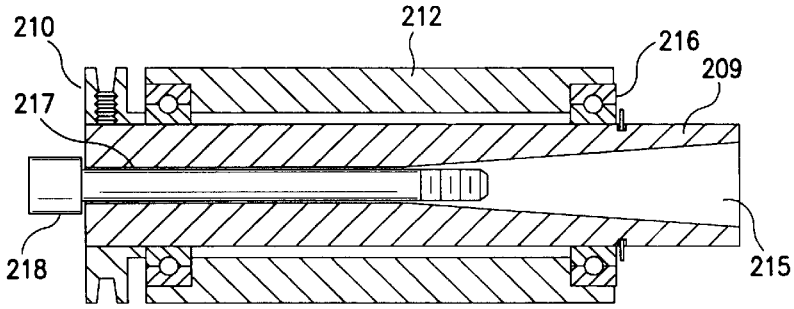
FIG. 23 is a sectional view along lines x—x of FIG. 22 showing the spindle embodiment utilized in FIG. 22.

For the aligned blocks 1*x*, 1*y* to be used as a center drilling lathe a motor 205 is mounted on top of tangent plate 8 by any suitable means. Shown is a strap 206 secured by screws 207 threaded into plate 8. As shown, the motor shaft 208 drives a spindle 209 via pulley 210 and belt 211. The spindle may instead be driven by gears meshed on the motor and spindle. A cartridge spindle 212 best seen in FIG. 23 simplifies center alignment, the spindle 209 turns via bearings 216 (ball or roller) that are housed in cylinderical member 212 having a precise o.d. The spindle member 209 has a coaxially internally bored taper 215 to accecpt standard collets or a taper shank chuck and the remainder of the spindle is clearance drilled 217 for draw bar screw 218 which may also have a coaxially thru hole. The tailstock portion 1*y* employs the same taper 203 as spindle 209 except that it has an o.d. equal to the cartridge bearing 212. As the V's are aligned and the fixtures made to the same specifications then securing two idential coaxial cylindrical members insures the centers will be precisely aligned for center drilling. The male member 94 acts as the bed of the lathe and assembly 1*y* as the tailstock. As with a lathe, the work rotates and the cutting tool does not. However, there is no reason that tailstock member 1*y* cannot employ a live spindle as well. Especially as this is believed to produce straighter holes in deep hole drilling. Unlike a lathe's tailstock the quill and screw have been eliminated with the drilling depth being controlled by the axial movement of member 1*y* sliding along male V 94. Thus, the potential drilling depth is almost the length of the male V member which can be made in different lengths and changed as necessary. The drilling embodiment of this invention is thus particularly suited to producing deep holes in small workpieces by the peck feed method taught by Frank 3,029,664 and utilized with peck drills described in a previous U.S. Pat. No. 6,031,156.

Figure 25:
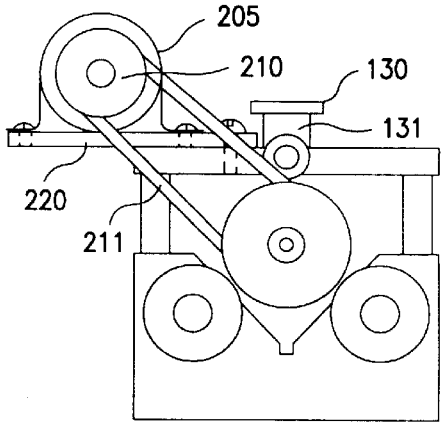
FIG. 25 is a rear end view of another motorized spindle embodiment of FIG. 22 that may also be employed as a motorized spin indexing fixture.

Alternatively the spindle 209 may be turned on the triple bearing arrangement as shown in FIGS. 17, 18 in which case a motor is secured in place of the indexing mechanism and a pulley is affixed to the back end of the spindle. Or an offset motor mount 220 may be employed as in FIG. 25. Whether or not used for the lathe this arrangement can be used for the spin indexer to eliminate manual cranking. With the triple bearing arrangement a different diameter cylindrical member 212 or parallels would be required to bring the center height of both headstock and tailstock into agreement.

Figure 24:
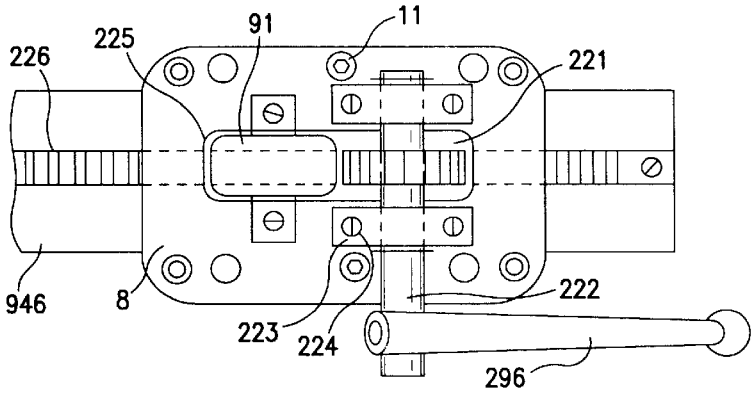
FIG. 24 is a bottom elevation view of the "tailstock " portion of FIG. 22.

Relative movement along the male V 94 is accomplished with the same mechanism used on the diamond dresser drill sharpener accessory shown in FIG. 14 (91). Motion is accomplished with the addition of a rack 226 and pinion 221 actuated by a lever 296 (FIG. 24). This is many times faster than winding a screw as with a conventional tailstock. The connection between the pinion shaft and the lever 296 may be made to ratchet. The depth of the stroke is controlled by threaded shaft 214 secured in one end of the V block assembly 1*x*. A clearance thru hole is drilled thru the other V block member 1*y* at the same coordinates so member 1*y* may slide freely along male V 94 with the threaded rod passing thru the clearance hole. The V member 1*y* slides until it encounters a graduated nut 215 that acts as a stop. Rotating the nut a discrete amount is used to control the peck depth for drilling deep holes.

The rack and pinion mechanism is shown in FIG. 24. A pinion gear 221 is pressed onto a pinion shaft 222 and is supported by one or more shaft supports 223 which is secured to cover 8 by screws 224 that thread into the cover 8. The bearing 91 and pinion gear 221 are mounted in line thru a milled slot 225 in the cover. They both project below the surface of the cover 8. The rack 226 may run the length of the male member 94 and is mounted in a milled slot so that the rack is below the surface of member 94*b*. The bearing 91 is wider than the rack and pinion so that the beating will still roll on male V 94 when moved. Alternatively the rack and pinion may be offset of the bearing.

Figure 26:
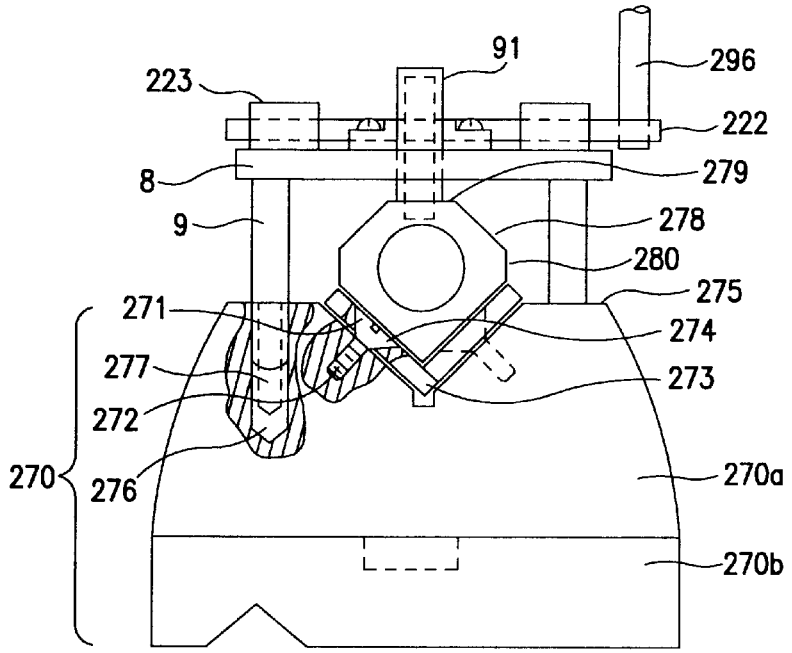
FIG. 26 is an end view of a tangent pin clamp and a V quill utilized in the tailstock of a lathe.
Figure 28:
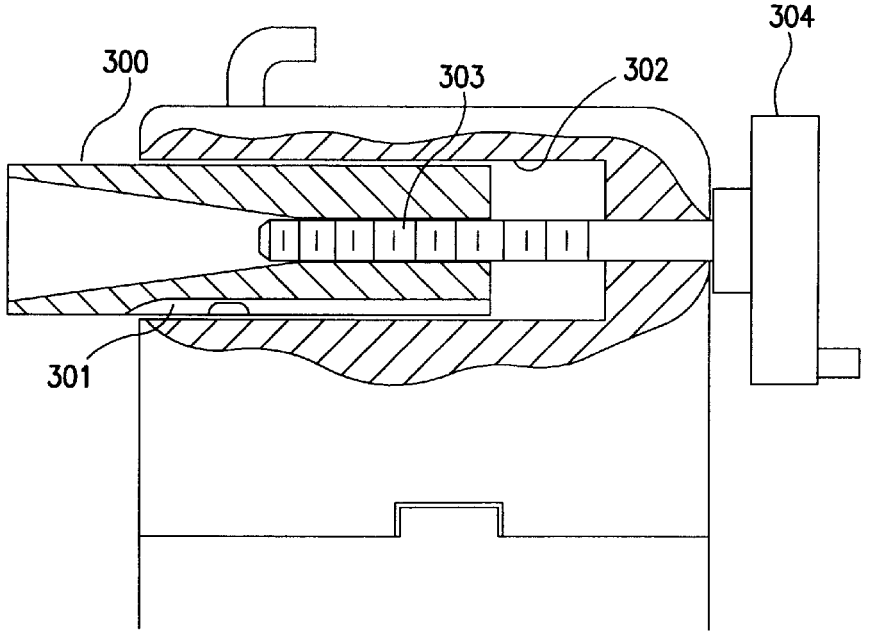
FIG. 28 is a side view partly in section of the prior art lathe tailstock.

From some of the forgoing applications and embodiments it should be noted another use for this invention outside workholding is possible. In FIG. 26 the tangent pin clamp and V arrangement is utilized in the tailstock of a lathe, replacing the conventional quill and screw of the prior art tailstock shown in FIG. 28. The prior art is characterized by a cylindrical quill 300 with a keyway 301 that fits into a close tolerance bore 302. The quill 300 is advanced by means of a screw 303 which the user cranks by means of handle 304. The bore must be machined in accurate alignment with the lathe headstock. An error in the cross axis is not a problem as this axis is adjustable and is a matter of scribing a witness line at the center position. An error in the height of the bore is not easily corrected. Additionally the bore needs to be accurately sized and wear is a significant issue. Further, the drilling and boring of the tailstock is not a particularly productive operation. In use, the cranking of the screw is slow and tedious, and for peck drilling applications winding the screw adds significantly to the time necessary to drill a deep hole. What's more, the stroke of the tool is quite limited in comparasion with the size of the lathe. For example a 12" lathe with a 24" bed would typically only have a 2–3" stroke.

In contrast, the current invention offers numerous advantages. Milling a V in the top of the casting can be accomplished more readily. In addition hardened wear plates secured to the V extend the life and accuracy of the tailstock and if worn the wear plates can be replaced restoring the original accuracy. Additionally an error in the height of the quill to the headstock can be corrected by grinding the wear plates. If the height is too low, a thicker wear plate is substituted or a shim is placed under the plate. In addition, it should be noted that the bore of a conventional tailstock must be larger than the quill for free operation. While this may only be 001"–002" it is a potential source of error for high precision work, especially with the quill ally extended. In the current invention the male V nesting in the female V removes all play from the components for greater accuracy. Additionally the stroke length of the quill can easily be 2–3 times that of prior art and having a lever controlled by rack and pinion is far more productive and less tiring than winding a screw.

As seen in FIG. 26 there is a tailstock 270 consisting of two cast iron sections 270*a* and 270*b*. As with a conventional tailstock it has provisions for moving the top member to offset or adjust the center alignment as is well known in the art, and which has provisions to lock the tailstock to the bed of the lathe. In top member 270*a* a V cavity is machined 271 and several holes drilled and tapped into each leg of the V 272. These holes secure hardened parallels 273 which have countersunk thru holes 274 matching the hole locations 272 in the V cavity. On the lands 275 on either side of the V are a series of reamed and threaded holes 276, 277 as are found on V fixture 1 in FIG. 1. In this particular embodiment the quill 278 is made from square stock and has a flat 279,280 on 1 or more corners. A coaxial hole is machined to accept standard machine tapers, typically Morse tapers. Along flat 279 a slot is milled for most of the length of the quill to accept a rack which is then secured below the surface of the flat. The tangent clamp 8 securing the quill utilizes the same embodiment seen in FIG. 24 with the bearing 91 and pinion 221 in line. The screws 11 retaining the cover 8 are adjusted until the bearing 91 rolls freely. The screws 11 may have a nylon patch so once adjusted they will not loosen and retain proper tension.

Figure 27:
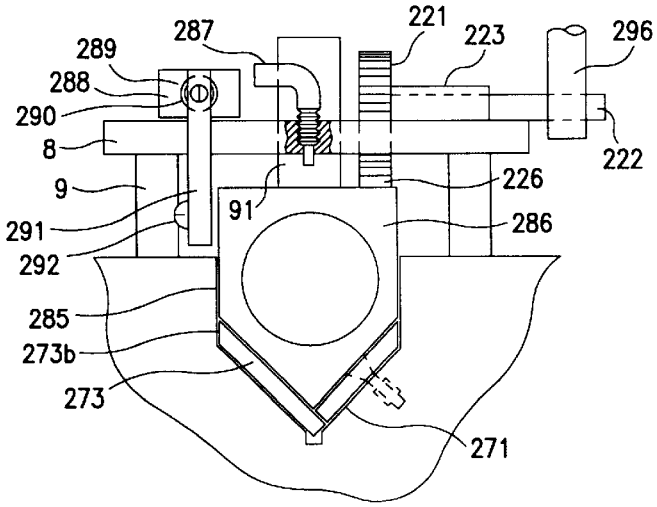
FIG. 27 is a segmented end view of another embodiment of the V quill tangent clamp tailstock.

Another embodiment is shown in FIG. 27. The difference of this embodiment from that in FIG. 26 is that the V cavity has a step so that the V 271 is at the bottom of a rectangular channel 285. This is more difficult to produce but the additional constraint may better resist torsional forces encountered in drilling. In addition the quill 286 is made from rectangular stock with a V being machined on one side. As the quill has more surface area the rack 226 may by located off to one side and need not be recessed and a smaller pinion may be used. The V liners 273 may have a 45 degree bevel at one end 273*b* offering full support to the quill. A quill lock 287 may simply be a hand screw that threads thru the cover 8. A quill stop may be achieved by mounting a block 288 atop tangent plate 8. The block has a clearance hole 289 for a threaded rod 290 which is a little longer than the length of the quill. A strap 291 connects the threaded rod 290 to the quill 286 by means of screws 292. As the quill is advanced the threaded rod is pulled along with it. A nut on the rod strikes the back end of block 288 and stops the quill. Adjusting the nut can control peck depth or the ultimate drill depth. It is also possible for the tailstock to utilize the roller beatings in FIG. 14*b*.

It should be understood that various departures may be made from the illustrated embodiments without departing from the scope and spirit of the invention. For example, the number and arrangement of hole location and locating pins in the V block may be changed. The invention should therefore not be limited except by the claims. Having described the above invention as a new and useful device I claim the following:

What is claimed is:

1. A V fixture comprising:

a V block comprising substantially flat, perpendicular sides any of which may be used as a reference surface, said block having a V cavity on a first side and a flat planar base on a second side which is opposite said first side, said block comprising a plurality of apertures extending from said first side to said second side; and a tangent contact clamping plate comprising a flat surface, said plate comprising a series of holes dimensioned for alignment with said apertures in said V block so that said plate is attachable to said first side or said second side of said block for reversing clamp orientation, said plate comprising at least two fixed pins for locating said plate in said V block.

2. A V fixture according to claim 1 wherein said locating pins are internally threaded.

3. A V fixture according to claim 1 wherein said clamping plate comprises a keyway style clamping plate having an inclined surface along the underside of the long axis of said plate to make contact with the workpiece.

4. A V fixture according to claim 3 in which said keyway clamp comprises an additional inclined surface along the opposite surface, the fixed pins being located in said keyway clamp so that said keyway clamp may be reversed giving greater access or accommodating larger work.

5. A V fixture according to claim 1 wherein said V block comprises alternating layers of magnetic and non-magnetic material.

6. A V fixture according to claim 1 wherein said V block comprises alternating segments of magnetic and non-magnetic material forming a checkerboard pattern.

7. A V fixture according to claim 1 wherein said clamping plate comprises a clear material.

8. A V fixture according to claim 1 comprising a motor mounted atop the plate to drive a spindle.

9. A V fixture according to claim 1 comprising a male V member, said male V member matching the V cavity of said V fixture.

10. A V fixture according to claim 9 further comprising a diamond dressing tool.

11. A V fixture according to claim 9 further comprising a dovetail slide fixture.

12. A V fixture according to claim 9 further comprising a gear rack to facilitate linear motion.

13. A V fixture according to claim 9 wherein said plate comprises means for facilitating the relative reciprocating linear motion between said V fixture and said male V member.

14. A V fixture according to claim 9 comprising a dovetail slide mechanism for use with the male V member, said dovetail slide mechanism comprising a shank portion for mounting, a female dovetail member, and an L shaped male dovetail member, said L shaped dovetail member comprising mounting holes and a strip of magnetic tape on its surface for mounting a drill fixture, wherein said dovetail slide moves relative to female dovetail by screw means engaging said male dovetail.

15. A V fixture according to claim 1 wherein each end of the V fixture is equipped with outboard bearings forming three point contacts supporting a rotating workpiece.

16. A V fixture according to claim 1 comprising a center finder for locating the V fixture in a workpiece directly under the spindle of a machine tool, said center finder comprising a chuckable shank portion centrally located in a block having a V shaped profile matching the V cavity in said V fixture, said center finder shank having a coaxial thru hole accommodating a headed pin having a conical point on the opposite end.

17. A V fixture according to claim 1 comprising a detachable sine base, said Sine base comprising locating holes corresponding to mounting holes in said V block.

18. A V fixture according to claim 1 further comprising a v style clamping member comprising identical dimensions to said V cavity and comprising a series of thru holes on either side of the V which communicate with said holes of said V block wherein at least two of the holes of said V clamping member accommodate fixed pins.

* * * * *